US006176613B1

(12) United States Patent
Chen

(10) Patent No.: US 6,176,613 B1
(45) Date of Patent: Jan. 23, 2001

(54) PACKING BAG WITH AIR CUSHION

(76) Inventor: Tzan-Kuo Chen, 1 Fl. No.25, Alley 17, Lane 12, Pated Rd., Sec 3, Taipei (TW)

( * ) Notice: Under 35 U.S.C. 154(b), the term of this patent shall be extended for 0 days.

(21) Appl. No.: 09/563,908

(22) Filed: May 4, 2000

(51) Int. Cl.[7] ..... B65D 30/00

(52) U.S. Cl. ..... 383/3; 383/10; 383/18; 383/61; 383/63; 206/522

(58) Field of Search ..... 383/3, 10, 61, 383/63, 18; 206/522

(56) References Cited

U.S. PATENT DOCUMENTS

| | | | | |
|---|---|---|---|---|
| 3,587,794 | * | 6/1971 | Mattel | 383/3 X |
| 4,155,453 | * | 5/1979 | Ono | 383/3 X |
| 4,262,801 | * | 4/1981 | Avery | 383/3 X |
| 4,503,558 | * | 3/1985 | Lief et al. | 383/3 |
| 5,316,386 | * | 5/1994 | Moore | 383/3 X |
| 5,540,366 | * | 7/1996 | Coomber | 383/63 X |

FOREIGN PATENT DOCUMENTS

| | | | | |
|---|---|---|---|---|
| 2339078 | * | 2/1975 | (DE) | 383/3 |
| 2367671 | * | 5/1978 | (FR) | 383/3 |

* cited by examiner

*Primary Examiner*—Jes F. Pascua
(74) *Attorney, Agent, or Firm*—Rabin & Champagne, P.C.

(57) ABSTRACT

A packing bag with an air cushion, the bag unit comprising a sealing part at its top and a containing part at its bottom, wherein, the bag unit of the sealing part is a single-layered structure, on its inside are several matching snap strips, the bag unit of the containing part is in the form of a pouch enveloped by partition areas between the inside bag and the outside bag, on one corner of the outside bag is an air nozzle, and on two sides of the containing part are carrying handles, when such a structure is put in use, air is inflated through the air nozzle into the pouch of the containing part, so the pouch is filled with air between the outside and the inside bags, forming a bag unit filled a layer of air to accommodate fresh foods, fragile objects or precious items, etc., and, the snap strips fitted at the sealing part can be pressed tight to seal the opening, and due to the air pouch of the containing part, the article contained inside the bag can be protected by such features as heat insulation, buffer resistance to impact, resistance to vibration, and when the invention is not to be used for an extended period of time, the air inside the containing part can be released, so the entire bag unit can be flattened and folded for storage, or carried from place to place, thereby achieving the functions of extensive applications, easy operation, convenient use, as well as excellent preservation of freshness and protection.

4 Claims, 8 Drawing Sheets

PACKING BAG WITH AIR CUSHION

BACKGROUND OF THE INVENTION

1. Field of the Invention

This invention relates to a packing bag with an air cushion, particularly to a packing bag comprising a sealing part at its top and a containing part at its bottom, the sealing part is a single-layered structure with snap strips, while the containing part is a pouch structure composed by partition areas between an inside and an outside bag, at one corner is an air nozzle, and on the outside of the bag are carrying handles. Before using it, air is inflated in the pouch of the containing part, forming a bag unit with a protective inflated layer, so the article contained in the containing part can be protected with heat insulation, preservation of freshness, resistance to impact, resistance to vibration, and when not in use, it can be flattened and folded for storage and carrying purposes.

2. Description of Related Art

Carrying, transporting or storing an article requires a packing bag to accommodate said article. A conventional packing bag, whether its material is plastics, paper or cloth, is generally a flexible single-layered structure. Such a conventional bag can be used to accommodate general goods. But in case the article to be contained is fresh food (such as sashimi box, cold food, etc.), a conventional bag having no such function as heat insulation, so the outside temperature will easily affect the food inside the bag, or the temperature of the food inside the bag (such as an iced food) will be radiated, resulting in loss of freshness and melting and deteriorating of the cold food during the delivery process. In case the article to be contained is fragile or valuable (such as glassware, ceramic ware, crystal ware, or more sophisticated electronic products, such as walkie-talkie, mobile phone, computer peripheral products, etc.), conventionally, a polystyrene or sponge designed to suit the configuration of the article to be contained is molded to accommodate the article, then the entire package is put inside a packaging box, which would result in sophisticated packaging process, higher costs in the production of polystyrene or sponge boxes. The conventional packing bag is too thin to have resistance to impact, therefore, once such articles are contained in the bag without buffers such as sponge or fabrics, the article can often be damaged or crushed during the handling process. To provide better protection to the contained article, the market has presented a type of bag with air bubbles on the inside of the bag (generally kraft paper). Since such a bag has this separating wall of air bubbles, providing a certain extent of protection to the article in the bag. But the thickness of bag with such air bubbles is not sufficient to provide adequate protection against impact and vibration, nor has the functions of heat insulation and preservation of freshness, so it is not suitable for containing fresh food. One more weakness is that such the air trapped inside air bubbles on that bag could not be released (once the air bubbles are crushed and the air released, they will no longer have the buffer effect against impact), therefore, when the bag is not in use, it could not be flattened or folded, and its size could not be reduced, resulting in space-consuming when it is to be stored or carried.

In view of this, the inventor has devoted in research and improvement aimed at redressing the shortcomings in conventional packing bags, such as inadequate protection against fresh food from deteriorating, or fragile or valuable items from breaking, and after repeated test production, tests and revisions, has finally come up with the present invention of packing bag with an air cushion that can be inflated to become an air pouch before it can be used to contain an article, the air pouch providing heat insulation and resistance to impact, so the heat of the food can be maintained, or the contained article can be protected.

BRIEF DESCRIPTION OF DRAWINGS

The invention can be fully understood by reading the following detailed description of the preferred embodiments, with reference made to the accompanying drawings, wherein.

BRIEF DESCRIPTION OF NUMERALS

| BRIEF DESCRIPTION OF NUMERALS |
|---|
| 10 sealing part |
| 11 snap strip |
| 12 open groove |
| 20 |
| 21 inside bag |
| 22 outside bag |
| 23 partition plate |
| 24 air nozzle |
| 25 carrying handle |
| 26 juts |
| 30 crushed ice cubes |

DETAILED DESCRIPTION OF PREFERRED EMBODIMENTS

Figure 1:
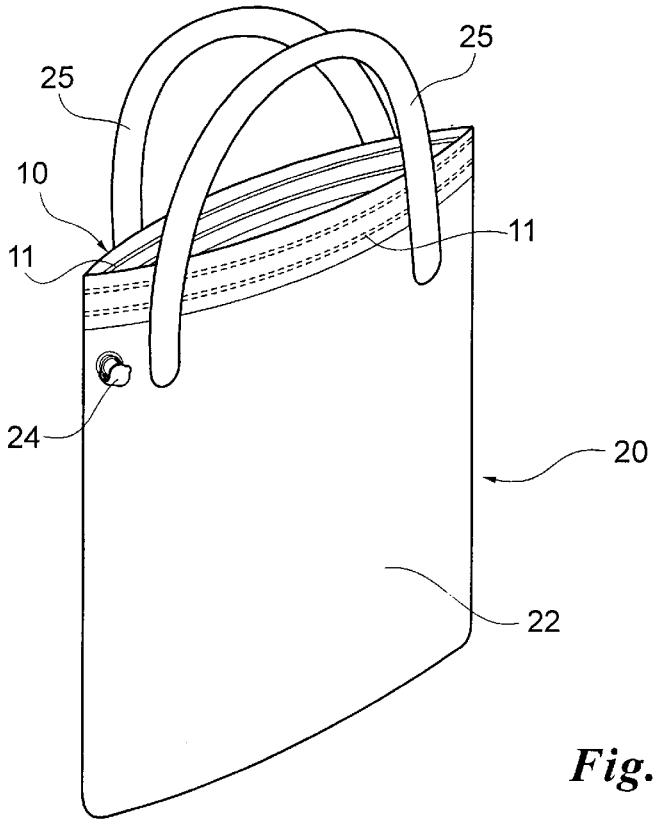
FIG. 1 is an exterior view of the invention.
Figure 2:
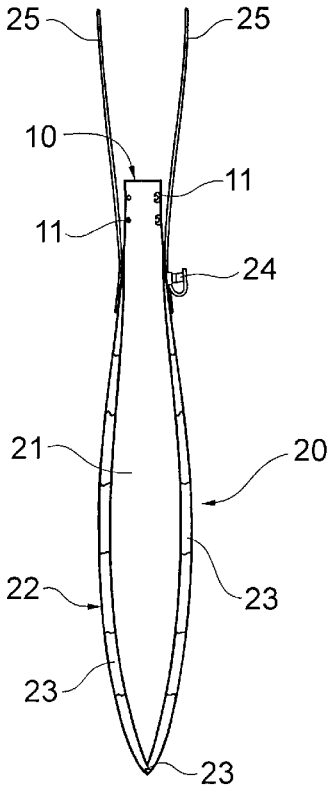
FIG. 2 is a section view of the invention.

Referring to FIGS. 1 and 2, this invention of bag preferably made of plastic materials (such as PVC), comprising a sealing part 10 located at the opening on top of the bag, and a containing part 20 located lower to accommodate the contents to be contained, wherein, the bag unit of the sealing part 10 is of single layer construction, on its inside are several matching snap strips 11, the snap strips 11 can be pressed and snapped together to seal the opening of the bag unit. The bag unit of the containing part 20 is composed of an inside bag 21 and an outside bag 22. At appropriate positions between the inside bag 21 and the outside bag 22 are a plurality of partition plates 23 (the shaded areas in the drawing, referring simultaneously to FIG. 3). Between the partition plates 23 are porous holes, thus the bag unit of the containing part 20 becomes a compartment structure. At one corner of the outside bag 22 is an air nozzle 24, and on the outsides of the bag unit are carrying handles 25.

Figure 3:
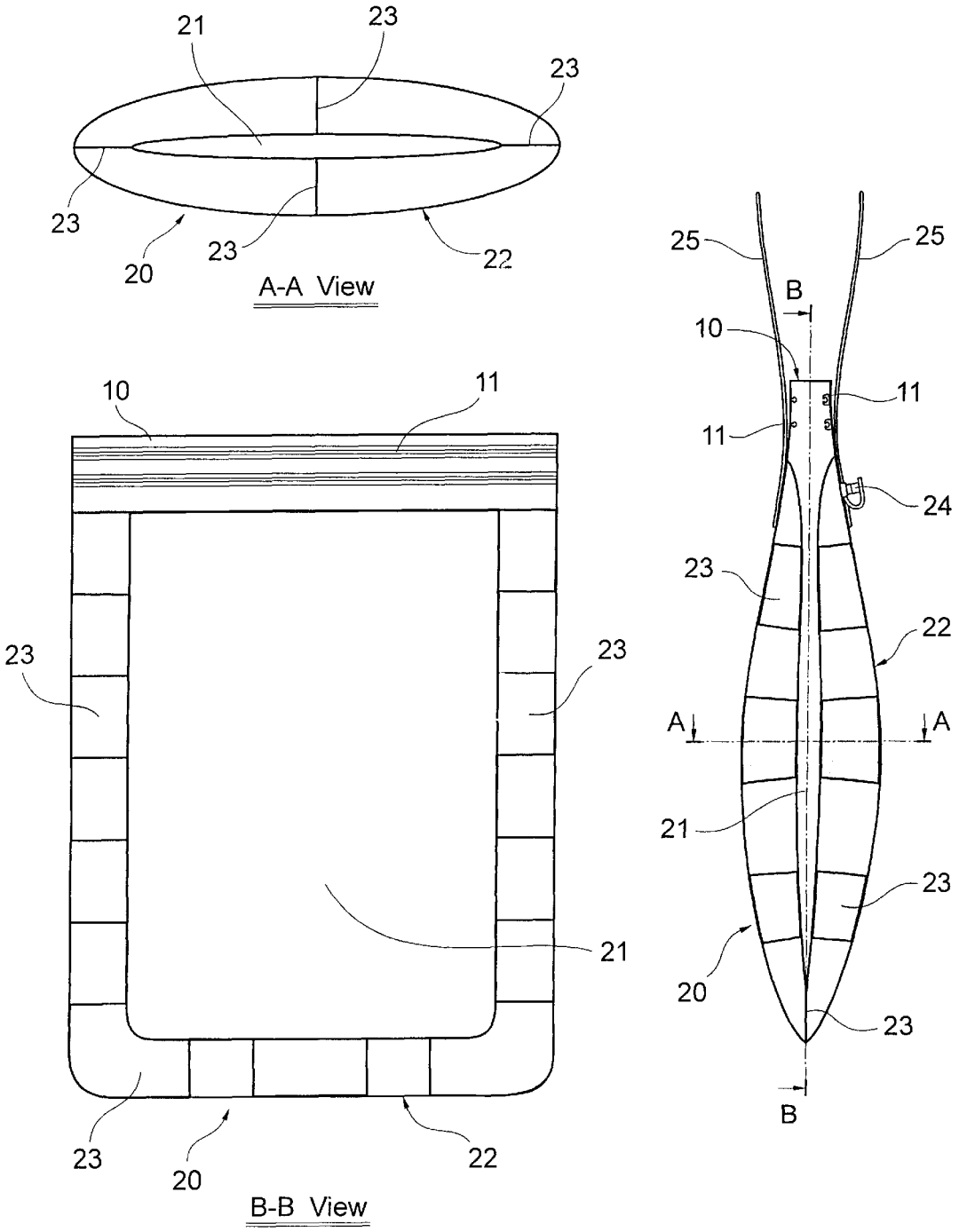
FIG. 3 illustrates section views of the invention from various angles when the filling part of the invention is inflated by air.
Figure 4:
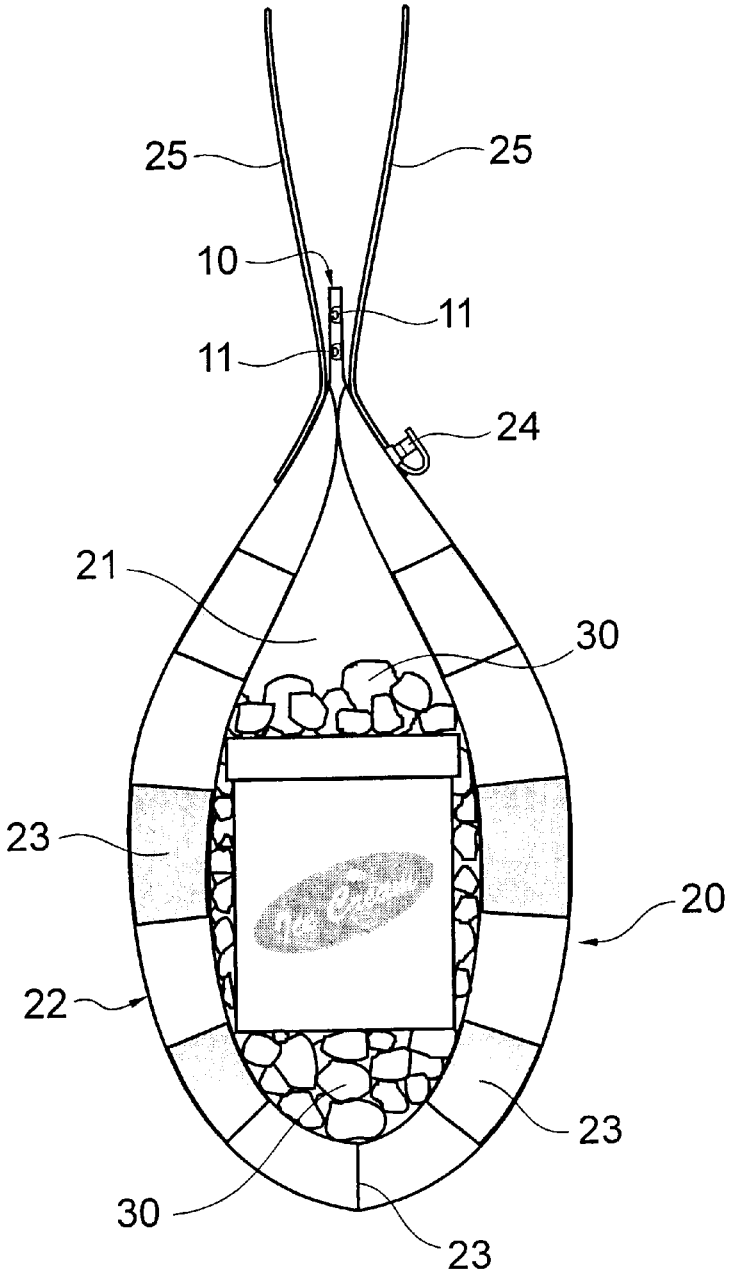
FIG. 4 illustrates a preferred embodiment of the invention containing fresh foods.
Figure 5:
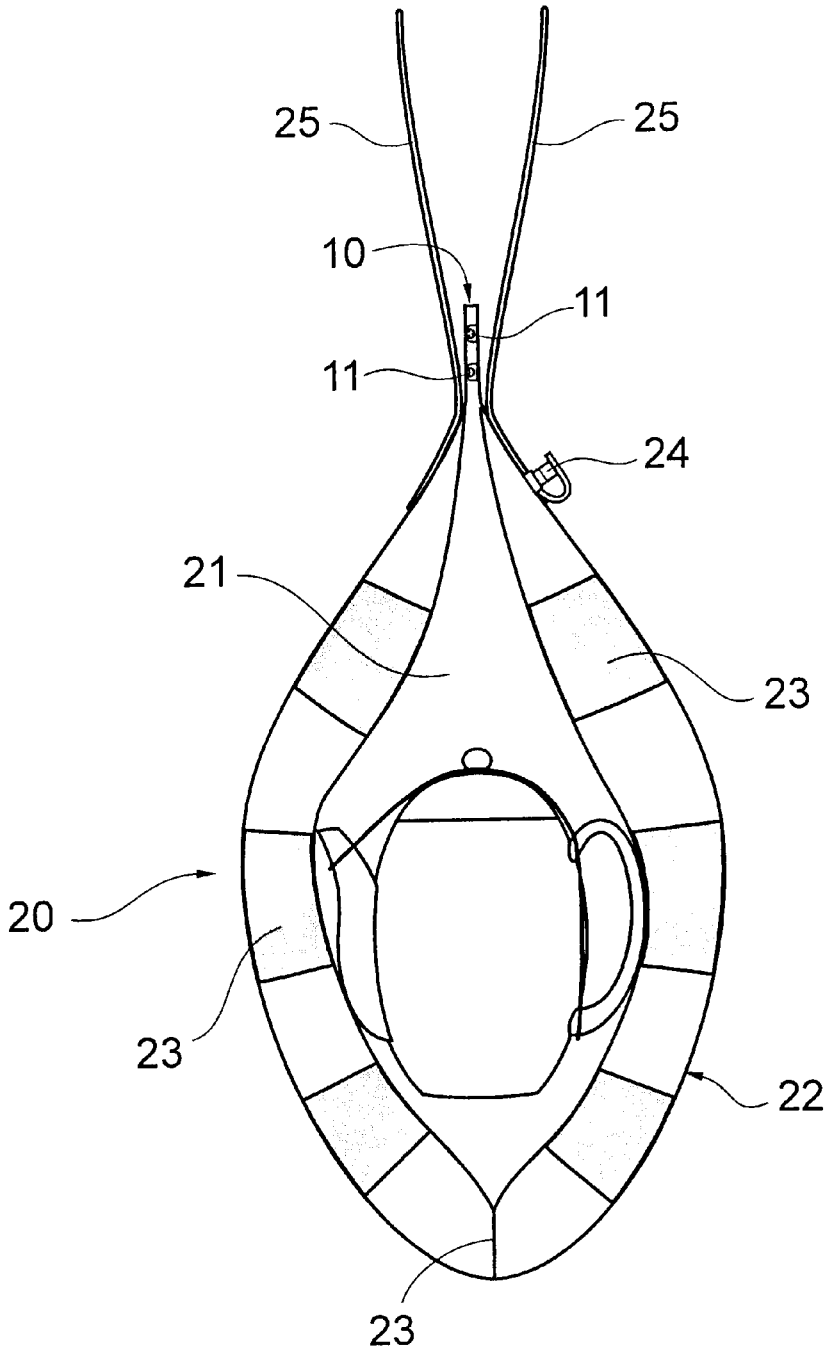
FIG. 5 illustrates a preferred embodiment of the invention containing a ceramic product.

FIG. 3 illustrates how the invention of the aforementioned structure can be used. The first step is to inflate air via the air nozzle 24 into the compartment between the inside bag 21 and the outside bag 22 of the containing part 20, forming a bag unit containing an inflated layer of an appropriate thickness. Then, the article to be contained can go through the sealing part 10 (not sealed at this time) and put inside the inside bag 21 of the containing part 20. After the article is put in place, the snap strips 11 at the sealing part 10 are pressed and snapped to seal the opening, forming a sealed bag filled like an air cushion; in case the article to be put inside the invention is fresh food (such as fresh sashimi box, ice-cream cone, etc.), crushed ice cubes 30 (or dry ice) can be put alongside the article inside the bag, as shown in FIG. 4. Then, the fresh food can be cooled and preserved by the crushed ice cubes 30 along its side. Moreover, since the air cushion of the containing part 20 can effectively insulate temperature differences inside and outside the bag, its excellent heat insulation and heat preservation effects will not only prevent the temperature outside the bag from permeating the bag (due to insulation by the air cushion), but will also maintain the freshness of the article inside the bag. Furthermore, the heat of the article inside the bag will not be radiated easily, so the freshness can be preserved and the ice will not melt. Even without putting the crushed ice cubes 30 inside the bag, such freshness can still be preserved by the insulation of temperature differences provided by the air cushion. In case the article in the invention is fragile or precious (such as glassware, ceramic ware, crystal products, precision electronic products, etc.), as shown in FIG. 5, the article contained in the containing part 20 can be properly protected, due to the buffer protection of the air cushion in all directions, when the invention is carried on the go, transported, or even if the bag is dropped onto the floor, or hit by other articles, or subjected to vibration or bumpy travel, etc., providing full-faceted protection efficiency unprecedented by conventional packing bags.

Figure 6:
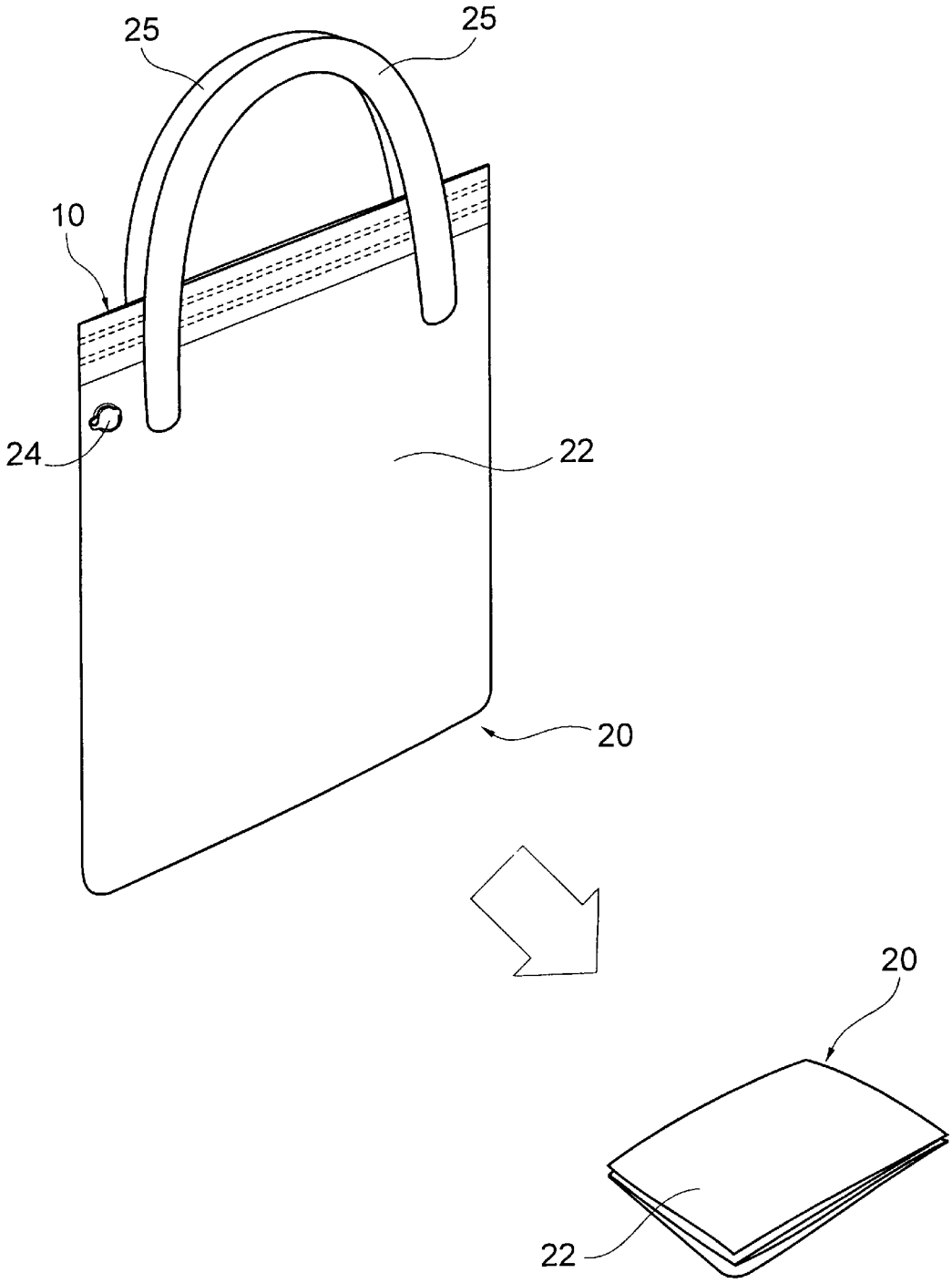
FIG. 6 illustrates how the invention is folded when not in use.

When the invention is to be stored for an extended period of time, the air trapped between the inside bag 21 and the outside bag 22 of the containing part 20 can be released completely through the air nozzle 21, as shown in FIG. 6. After air is released, the whole bag can be flattened completely, and folded appropriately to a fully reduced size that can be put inside a pocket, a drawer, a handy pack or a handy bag, so it can be easily carried or stored. Particularly, when the user is going on a shopping trip, he can carry this invention to the shopping mall, spread and inflate the invention, put any fresh food or article inside the invention and carry it home. In other words, this invention that can be used repeatedly will have protective effects and environmental protection functions.

Figure 7:
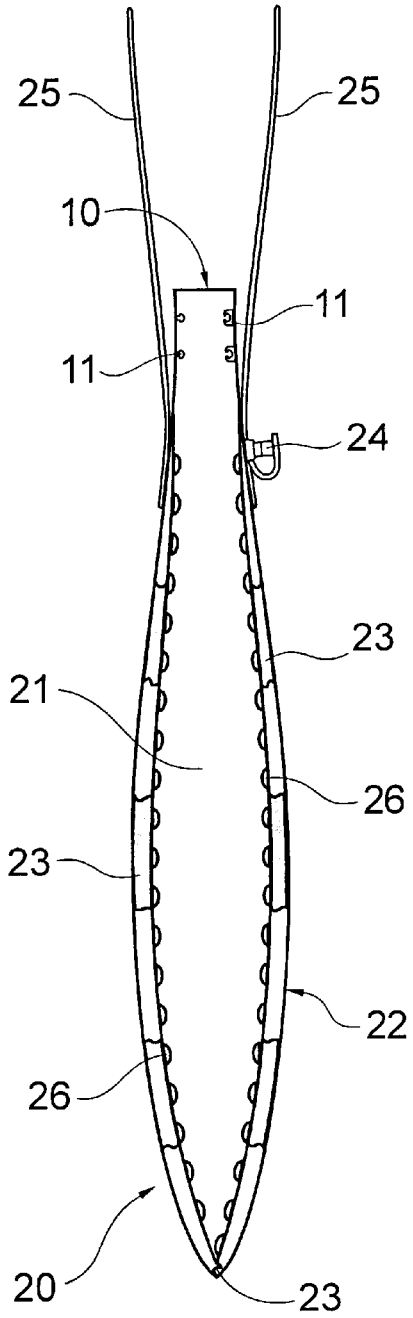
FIG. 7 illustrates a preferred embodiment of the invention with its inside wall fitted with flexible juts.
Figure 8:
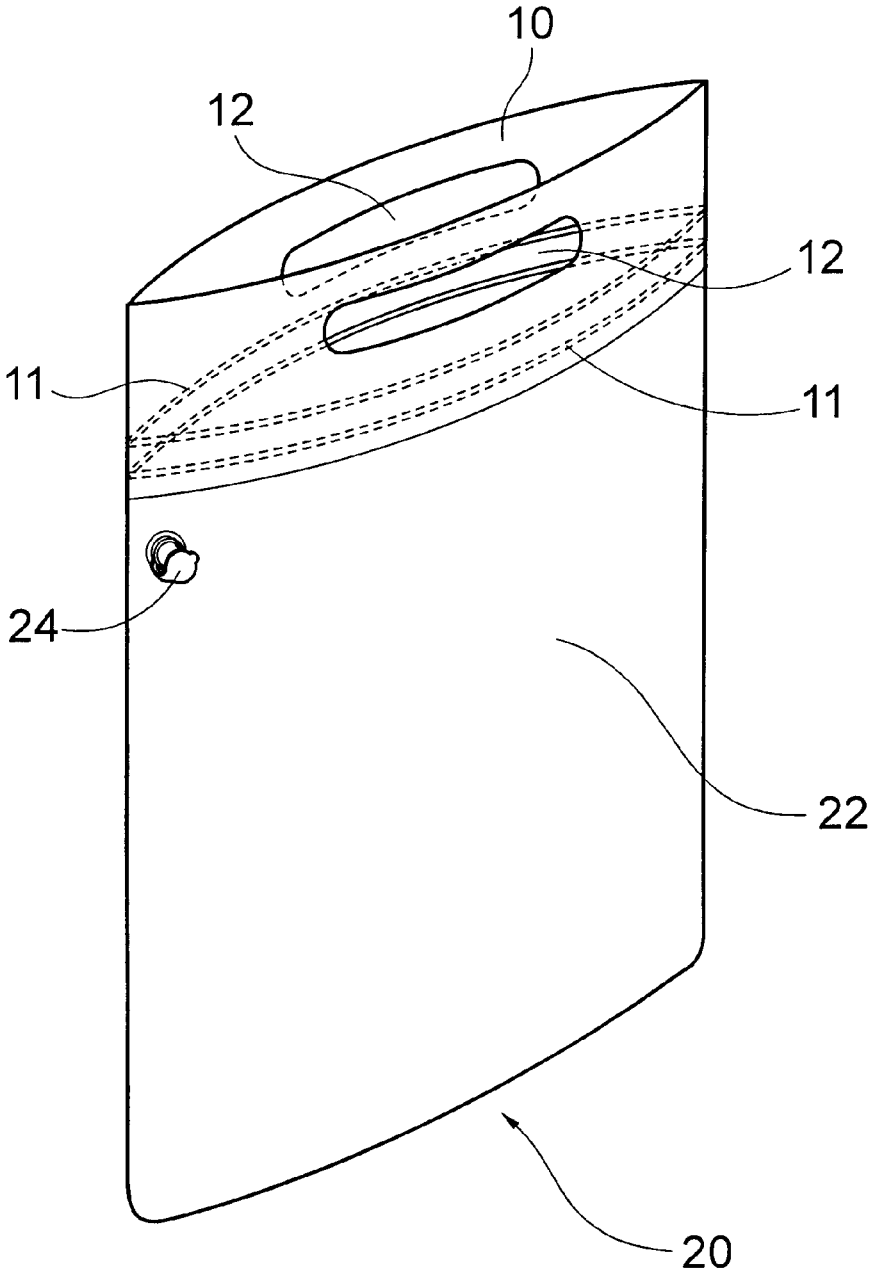
FIG. 8 illustrates a preferred embodiment of the invention with its sealing part designed to have slots for carrying convenience.
Figure 9:
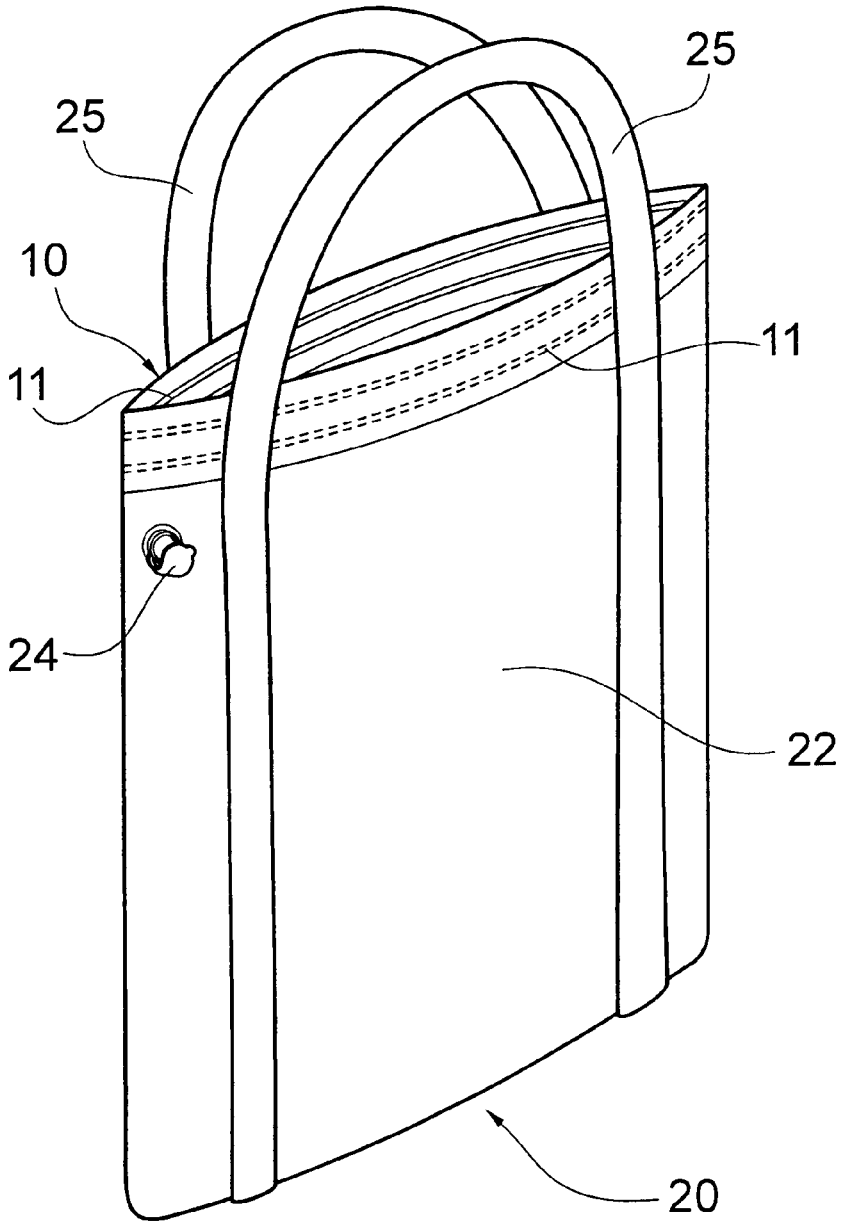
FIG. 9 illustrates a preferred embodiment of the invention with its carrying handles designed to go around the bottom of the bag.

In addition to the basic structure illustrated in the aforementioned preferred embodiment, this invention may have several lines of flexible juts distributed on the inside of the containing part 20, as shown in FIG. 7, so that the article contained in the bag can be surrounded in position by the juts 26, so as to reduce the possibility of displacement or swaying of the article inside the bag, and to assure better protection on the article. Or, as shown in FIG. 8, the carrying handles of this invention can be replaced by two slots 12 at the sealing part 10, to facilitate insertion of the user's hands into the slots 12, to carry the bag conveniently. To increase the loading capacity of the bag unit, the carrying handles 25 can be designed to go around the bottom of the bag, as shown in FIG. 9. Therefore, all modifications and variations made without changing the characteristics of this invention shall be included in the spirit and intent of this invention.

As described above, the invention is an exquisitely designed structure to provide the packing bag with a protective air cushion, and a sealing structure at the opening of the bag to prevent the article contained inside the bag from falling out, thus to effectively redress the drawbacks of the conventional packing bags, and further to provide excellent characteristics such as heat insulation, preservation of freshness, buffer resistance to impact, resistance to vibration, easy and convenient unfolding and folding of the bag unit. With its inventive step, improved features and usefulness, the invention has the aforementioned advantages over the prior art. Accordingly this application is filed. Your favorable consideration will be appreciated.

What is claimed is:

1. A packing bag with an air cushion, the main bag unit comprising a sealing part at its top end with an opening, and a containing part at its lower part in which articles can be contained, wherein the bag unit of the sealing part is of a single-layer structure, on its inside being a plurality of snap strips opposing each other, the bag unit of the containing part being composed of an inside bag and an outside bag, at appropriate locations between the inside bag and the outside bag being a plurality of partition areas, between the partition areas being through holes to form a pouch of the containing part, on one corner of the outside bag being an air nozzle, and on two outsides of the bag unit being carrying handles.

2. The packing bag with an air cushion as claimed in claim 1, wherein the inside bag of the containing part includes a plurality of flexible juts.

3. The packing bag with an air cushion as claimed in claim 1, wherein the carrying handles are slots at the sealing part.

4. The packing bag with an air cushion as claimed in claim 1, wherein the carrying handles go around the bottom of the bag unit.

* * * * *